United States Patent [19]

Nordmeyer et al.

[11] Patent Number: 4,646,318

[45] Date of Patent: Feb. 24, 1987

[54] CRUCIBLE FURNACE WITH ADJUSTABLE ELECTRODES

[75] Inventors: Friedrich Nordmeyer, Mettmann; Eckard Schunk, Düsseldorf, both of Fed. Rep. of Germany; Frank Winter; C. L. Jackson, both of Wrexham, both of United Kingdom

[73] Assignee: Mannesmann Aktiengesellschaft, Dusseldorf, Fed. Rep. of Germany

[21] Appl. No.: 737,415

[22] Filed: May 24, 1985

[30] Foreign Application Priority Data

May 24, 1984 [DE] Fed. Rep. of Germany ..... 3419681

[51] Int. Cl.[4] ..... H05B 7/101

[52] U.S. Cl. ..... 373/105; 373/100; 373/94

[58] Field of Search ..... 373/108, 107, 105, 55, 373/94, 100, 101, 98, 99

[56] References Cited

U.S. PATENT DOCUMENTS

| | | | |
|---|---|---|---|
| 3,612,739 | 10/1971 | Korneff | 373/78 |
| 3,612,740 | 10/1971 | Gierek | 373/78 |
| 3,835,230 | 9/1974 | Yordanov et al. | 373/108 |
| 4,132,545 | 1/1979 | Rabinovich et al. | 373/55 |

FOREIGN PATENT DOCUMENTS 2125773 of 0000 Fed. Rep. of Germany .

*Primary Examiner*—Roy N. Envall, Jr.
*Attorney, Agent, or Firm*—Oblon, Fisher, Spivak, McClelland & Maier

[57] ABSTRACT

A crucible furnace including a furnace vessel in which a graphite electrode and a metal contact electrode are vertically and horizontally movable.

8 Claims, 1 Drawing Figure

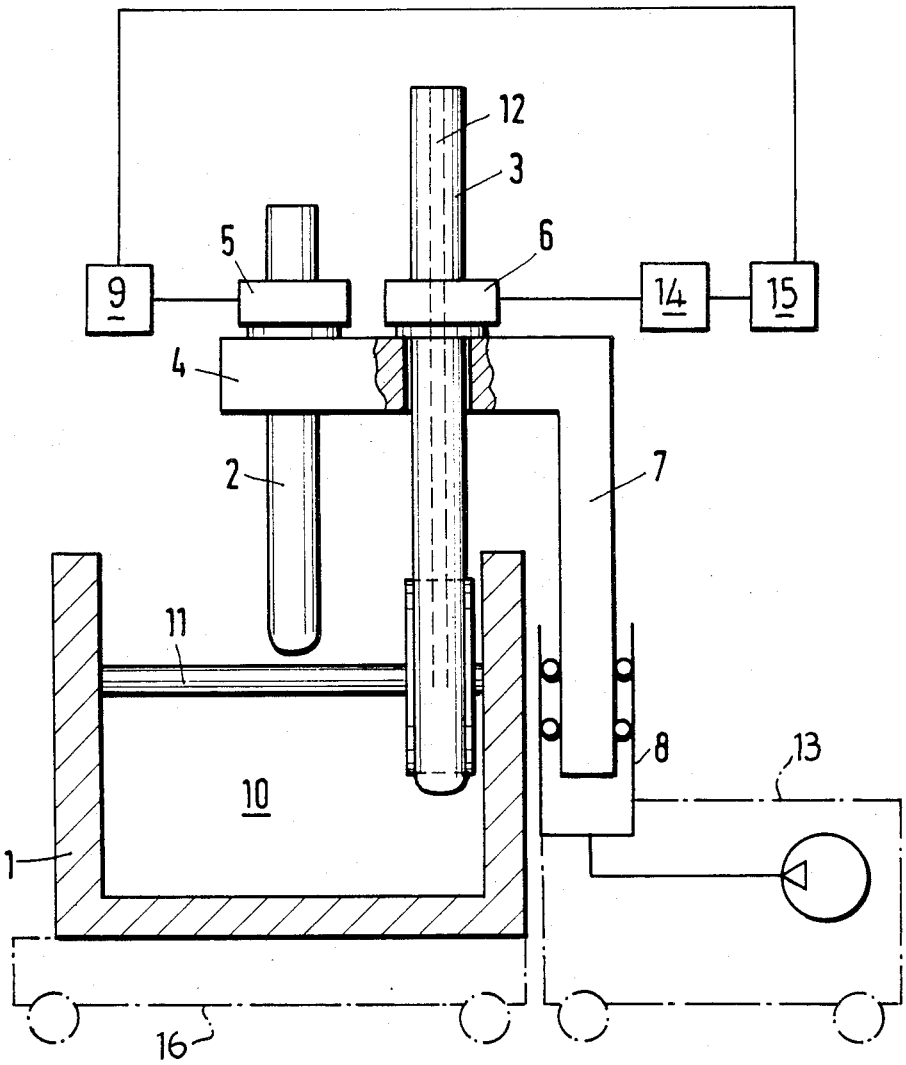
12
3
5
6
9
14
15
4
2
7
11
8
13
10
1
16

CRUCIBLE FURNACE WITH ADJUSTABLE ELECTRODES

FIELD OF THE INVENTION

The invention relates to a crucible furnace in which an arc is developed between a sacrificial metal electrode and a vertically adjustable graphite electrode.

BACKGROUND OF THE INVENTION

In crucible furnaces in which one electrode is a sacrificial metal electrode, a graphite electrode is usually connected as the cathode, while the sacrificial metal electrode operates as an anode.

A crucible furnace employing direct current which has an arc electrode operating as a cathode is known from German published patent Document DE-OS 31 07 454. Contact blocks of a metal are provided close to the bottom area of the furnace vessel. The contact blocks are on the side turned toward the center of the furnace vessel, which is provided with refractory brick with conductive inserts. Since this device has laterally connected contact electrodes, it is supposed to achieve the advantage that the bottom remains free for bottom tap holes. However, this device has the disadvantage that, when the contact blocks are consummed or damaged, replacement work is difficult and costly, since the contact blocks are solidly connected to the vessel.

OBJECTS OF THE INVENTION

The principal object of the invention is to provide a direct-current arc heating crucible furnace in which contact electrodes are movable in both the vertical and horizontal directions, whereby repair or replacement work on the electrodes is substantially easier than has been feasible up to now.

A further object of the invention is to provide a direct-current arc heating crucible furnace in which the electrodes are usable with a number of replaceable vessels.

SUMMARY OF THE INVENTION

According to the invention, it is possible to regulate the immersion depth of the contact electrodes placed readjustably above the vessel, depending on operational requirements. Moreover, the contact electrode and the graphite electrode can easily be removed from the vessel and used for another exchange vessel. Thus the cycle of the metallurgical process can be accelerated without increased cost.

By direct internal cooling of the metal contact electrode, the life of the crucible furnace can be substantially prolonged.

The greatest heat stress of the contact electrode arises, as is known, at it surfaces which contact the liquid melting bath. Therefore, the electrode according to the invention can be provided with a thermal shield in its lower area that is in contact with the slag on top of the liquid metal.

By the arrangement of electrodes according to the invention, the radiation load of the refractory material is substantially reduced. Moreover, operating costs are lowered by a smaller consumption of electrodes.

The device is suitable both for vacuum processes and processes which employ a protective gas covering.

BRIEF DESCRIPTION OF THE DRAWING

The single drawing is a diagramatic drawing of the presently preferred embodiment of the invention.

DETAILED DESCRIPTION OF THE PREFERRED EMBODIMENT

Above a furnace vessel 1, a graphite electrode 2 and a metal contact electrode 3 (made of steel in the example shown) are fastened to a common support arm 4. The graphite electrode 2 is mounted in a slipping device 5, while the readjustment device for the metal contact electrode 3 is referenced as 6. The slipping device 5 and the readjustment device 6 may be of any known type—for instance, that disclosed in published German patent Document DE-PS 21 25 773. Moreover, the graphite electrode 2 and the metal contact electrode 3 are vertically movable in the slipping device 5 and the readjustment device 6 in a known manner by a drive motor 9 and a drive motor 14, respectively.

In another embodiment, which is not shown, separate arms can be provided for the graphite electrode 2 and for the metal contact electrode 3.

The support arm 4 is fastened to a guide column 7 that can be vertically adjusted (together with both the graphite electrode 2 and the metal contact electrode 3 in the illustrated embodiment) with the help of a hydraulic cylinder 8. To permit the changing of the furnace vessel 1, both the graphite electrode 2 and the metal contact electrode 3 can be lifted out of the furnace vessel 1.

As is well known, the vertical position of the graphite electrode 2 is regulated so that an arc between the graphite electrode 2 and the metal contact electrode 3 is maintained.

The metal contact electrode 3 is gradually lowered into a melting bath 10 in the furnace vessel 1 as a function of the speed at which the metal contact electrode 3 is consumed. The readjustment device 6, the drive motor 14, and a control device 15 are employed in known manner to see to it that sufficient contact with the melting bath 10 is assured.

A slag layer on top of the melting bath 10 is designated by the numeral 11.

In the example shown, the metal contact electrode 3 has an axial bore 12 or a closed loop composed of two spaced passages joined at or near the lower end of the metal contact electrode 3 which makes possible an intensive cooling (e.g., by cooling gases such as argon).

The crucible furnace according to the invention can be operated either as a stationary unit or on a transfer car 16. Similarly, the guide column 7 and the hydraulic cylinder 8 can be operated either as a stationary unit or on a transfer car 13.

What is claimed as new and desired to be secured by Letters Patent of the United States is:

1. A crucible furnace comprising:

(a) a furnace vessel;

(b) a supporting arm disposed above said furnace vessel;

(c) a graphite electrode mounted in said supporting arm for vertical movement relative thereto;

(d) first means for moving said graphite electrode vertically relative to said supporting arm into and out of said furnace vessel;

(e) a metal contact electrode mounted in said supporting arm for vertical movement relative thereto;

(f) second means for moving said metal contact electrode vertically relative to said supporting arm into and out of said furnace vessel;

(g) a vertical guide column on which said supporting arm is mounted; and (h) third means for moving said vertical guide column vertically relative to said furnace vessel.

2. A crucible furnace as recited in claim 1 wherein said third means comprise a hydraulic cylinder.

3. A crucible furnace as recited in claim 1 wherein the vertical movement of said metal contact electrode in said supporting arm is controlled by a control device as a function of the speed at which said metal contact electrode is consumed.

4. A crucible furnace as recited in claim 1 wherein said vertical guide column is mounted on a horizontally movable transport means.

5. A crucible furnace as recited in claim 1 wherein at least one passageway for cooling fluid is located in said metal contact electrode.

6. A crucible furnace as recited in claim 1 wherein said crucible furnace comprises a plurality of furnace vellels each of which is selectively replaceable with another one of said plurality of furnace vessels.

7. A crucible furnace as recited in claim 1 wherein said metal contact electrode is provided with a thermal shield surrounding said metal contact electrode at the level which, during use of the crucible furnace, is in contact with the slag on top of the liquid metal in said furnace vessel.

8. A crucible furnace as recited in claim 1 wherein said furnace vessel is mounted on a horizontally rovable transport means.

* * * * *